US006752431B1

(12) United States Patent
Matthews et al.

(10) Patent No.: US 6,752,431 B1
(45) Date of Patent: Jun. 22, 2004

(54) PEEL-BACK, RE-SEALABLE MULTI-PLY LABEL

(75) Inventors: Lowell F. Matthews, Los Alimitos, CA (US); Paulette J. Carnes, Huntington Beach, CA (US); Craig J. Wiener, La Habra, CA (US)

(73) Assignee: Ampersand Label, Inc., Garden Grove, CA (US)

( * ) Notice: Subject to any disclaimer, the term of this patent is extended or adjusted under 35 U.S.C. 154(b) by 116 days.

(21) Appl. No.: 10/094,479

(22) Filed: Mar. 8, 2002

(51) Int. Cl.[7] ..... B42D 15/00; G09F 3/02

(52) U.S. Cl. ..... 283/81; 428/40.1; 428/42.2; 428/42.3; 428/343; 428/354; 428/192; 283/101

(58) Field of Search ..... 428/40.1, 42.2, 428/42.3, 343, 354, 192; 283/80, 81, 101

(56) References Cited

U.S. PATENT DOCUMENTS

| | | | | |
|---|---|---|---|---|
| 2,825,159 | A | | 5/1958 | Schor |
| 2,855,707 | A | | 10/1958 | Schor |
| 4,159,586 | A | | 7/1979 | Blum |
| 4,271,223 | A | | 6/1981 | Lambert et al. |
| 4,324,058 | A | | 4/1982 | Sherwick et al. |
| 4,587,158 | A | | 5/1986 | Ewing |
| 4,592,572 | A | * | 6/1986 | Instance ..... 281/2 |
| 4,720,416 | A | | 1/1988 | Duncan |
| 4,727,667 | A | | 3/1988 | Ingle |
| RE32,929 | E | | 5/1989 | Ewing |
| 4,911,477 | A | | 3/1990 | Shishido |
| 4,964,513 | A | * | 10/1990 | Ingram et al. ..... 206/459 |
| 5,074,595 | A | | 12/1991 | Hill et al. |
| 5,151,309 | A | | 9/1992 | Dollinger |
| 5,234,735 | A | | 8/1993 | Baker et al. |
| 5,264,265 | A | | 11/1993 | Kaufmann |
| 5,284,363 | A | | 2/1994 | Gartner et al. |
| 5,302,431 | A | | 4/1994 | Schultz |
| 5,314,421 | A | | 5/1994 | Leuenberger |
| 5,342,093 | A | | 8/1994 | Weernink |
| 5,376,417 | A | | 12/1994 | Amano et al. |
| 5,389,415 | A | | 2/1995 | Kaufmann |
| 5,455,092 | A | | 10/1995 | Tung |
| 5,468,535 | A | | 11/1995 | Amano et al. |
| 5,588,239 | A | | 12/1996 | Anderson |
| 5,855,434 | A | | 1/1999 | Hagen |
| 5,860,238 | A | | 1/1999 | Anderson |
| 5,863,628 | A | | 1/1999 | Barry |
| 5,904,973 | A | | 5/1999 | Coward et al. |
| 5,972,455 | A | | 10/1999 | Barry |
| 5,975,582 | A | | 11/1999 | Treleaven |
| 6,027,598 | A | | 2/2000 | Anderson |
| 6,035,568 | A | | 3/2000 | Grosskopf et al. |
| 6,054,006 | A | | 4/2000 | Pilon et al. |
| 6,082,777 | A | | 7/2000 | Grosskopf et al. |
| 6,103,326 | A | | 8/2000 | Kobayashi |
| 6,113,271 | A | | 9/2000 | Scott et al. |
| 6,213,520 | B1 | | 4/2001 | Treleaven et al. |

* cited by examiner

*Primary Examiner*—Daniel Zirker
(74) *Attorney, Agent, or Firm*—Wood, Herron & Evans, LLP

(57) ABSTRACT

A peel-back, re-sealable multi-ply label in which a first portion of an upper ply is substantially coextensive with a base ply to form a two-ply panel, and in which a second portion of the upper ply extends beyond the base ply in at least one direction to form a single-ply panel. The lower surfaces of the base ply and the second portion of the upper ply are adapted to be substantially permanently attached to a container surface by a pressure-sensitive adhesive. The lower surface of the first portion of the upper ply is coated with a pressure sensitive adhesive and is releasably bonded to the base ply by a release coating therebetween, enabling the first portion to be peeled back to reveal printed matter on the base ply and lower surface of the upper ply, and subsequently re-sealed.

46 Claims, 5 Drawing Sheets

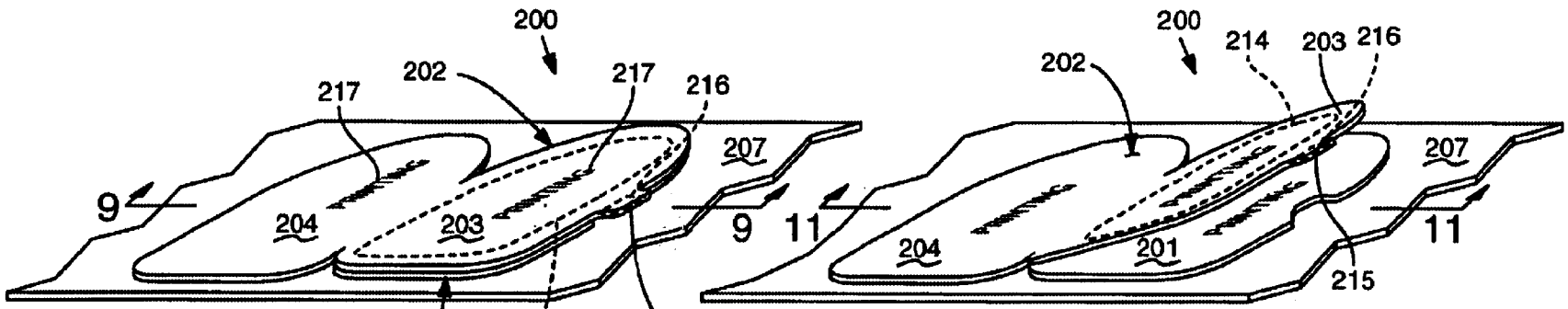
FIG. 8
FIG. 10
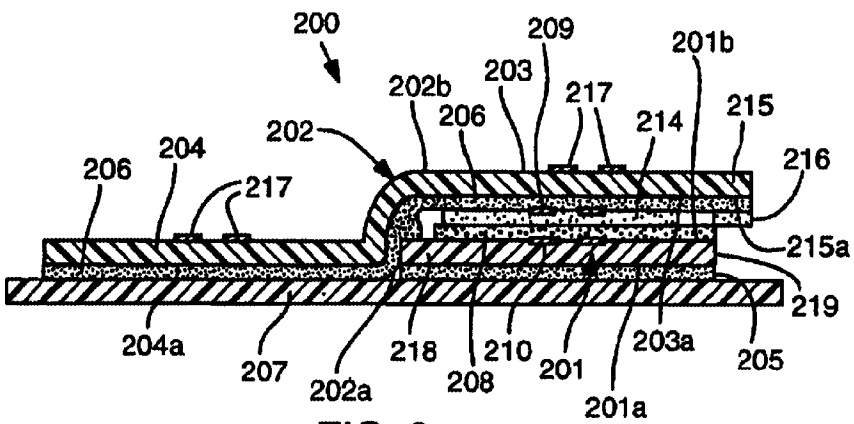
FIG. 9
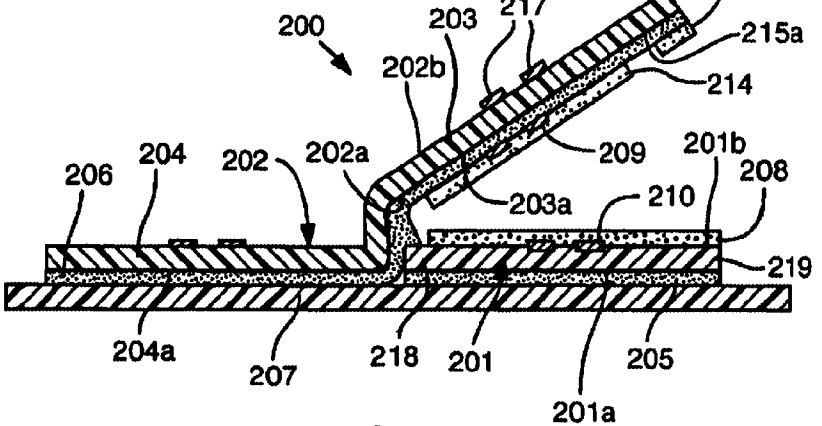
FIG. 11

PEEL-BACK, RE-SEALABLE MULTI-PLY LABEL

FIELD OF THE INVENTION

This invention relates to labels having multiple layers with more than one exposed surface for printed matter, and more specifically, to labels having a single-ply portion and a multi-ply portion, and a method for making such labels.

BACKGROUND OF THE INVENTION

The packaging industry has long had an interest in the manufacture and use of multiple layer labels as a means of increasing available graphic and text area where use of a single layer label affixed to a container would lack such extra print space. The demand for increased label print space arises from governmental labeling laws, need for multiple language instructions and warnings, promotional messages, and the like. The term "expanded content label" (ECL) is used to refer to multiple layer labels providing more that one exposed label surface for printing.

Many ECL constructions have been disclosed, with most falling into one of several general categories. One category of ECL constructions is disclosed by Barry (U.S. Pat. Nos. 5,972,455 and 5,863,628) and Anderson (U.S. Pat. Nos. 5,588,239, 5,860,238 and 6,027,598), for example, in designs that use multi-folded leaflets or booklets affixed to a base label which are in turn applied to containers, usually by means of a pressure-sensitive adhesive coated on the underside of the base label.

A second category of ECL constructions is disclosed by Ingle (U.S. Pat. No. 4,727,667) and Weernink (U.S. Pat. No. 5,342,093), for example, and relates to the use of a single strip of pressure sensitive label material usually patterned with release coatings and/or adhesive deadeners. The usually long resultant label strips are commonly referred to as "wrap around" labels as they normally are applied around a container's entire perimeter and additional lengths of the label continue to wrap on themselves.

A third category of ECL constructions, which will be referred to as "multi-ply" ECL labels, is disclosed by Gartner (U.S. Pat. No. 5,284,363) and Kaufmann (U.S. Pat. Nos. 5,264,265 and 5,389,415), for example, and relates to the use of two or more layers or plies of pressure sensitive label material. Specifically, a base ply is provided having pressure sensitive adhesive on its underside or lower surface for eventual application to a surface, such as a package or bottle. A second layer of material with pressure sensitive adhesive is superposed on the base ply. This upper ply can be partially peeled away from the base ply for viewing of text and graphics. This peel-away feature is typically accomplished through the use of release coatings on the base ply in those areas that are in contact with the upper ply's adhesive coat. Areas on the base ply without such release coating result in a more-or-less permanent bond between the base ply and the upper ply. This permanently bonded region acts as a living hinge, allowing the upper label ply to be peeled back for viewing and then to be reapplied to the base ply in perfect register. However, the multi-ply labels disclosed in the prior art have certain limitations.

First, the current designs for ECL labels incorporate the use of a pattern release coating on the upper surface of the base ply as a means of forming a living hinge between the edge of the base ply and the edge of the upper ply with a non-release region, void of release coating, defining the "hinge" attachment area on the base ply. During production, the use of a pattern release coating (to allow for the "non-release region") necessitates the need for expensive printing devices to apply a pattern versus the use of an inexpensive "tint roll" to "flood coat" print roll, if the pattern release were otherwise not needed. Accordingly, it is desirable to provide an ECL construction that eliminates the need for a pattern release coat on the base layer as a means to form a living hinge.

Second, the current designs for multi-ply ECL labels rely on the adhesive bonding force in the "hinge" area to adequately insure that the upper ply and the base ply do not become completely separated when opened for viewing. However, there is normally only a small amount of hinge securing area (non-release region) available at the edge in light of the often-congested text requirements to be printed on the base ply. Also, the hinging relies on the accurate placement of the non-release varnish area. Misregistration of the pattern release coating will result in an ineffective hinge caused by the non-release region being mislocated or even absent. Further, after one or multiple viewings of the "inside" text by peeling open then subsequently closing the upper ply, the hinge area is weakened and subject to tearing apart. Lastly, the surface of the base ply may not be as conducive to forming a strong hinge. For example, a paper base ply is likely to tear apart at the hinge due to the poor strength characteristic of paper as compared to most plastics. The integrity of the entire label, with the top and bottom plies remaining intact via the hinge is particularly important where governmentally regulated information is involved, as is common in pharmaceuticals. Accordingly, it is desirable to provide an ECL construction that insures that the upper ply, often imprinted with important information, will remain permanently bonded with the container even after multiple viewings.

Third, the current designs for multi-ply ECL labels depict the base ply as being coextensive with the upper ply, with the occasional exception of a relatively small, extended peel-tab structure. When such labels are applied to curved, non-planar, and/or deformable surfaces such as a cylindrical bottle or squeeze tube, the results are often not satisfactory. Specifically, a multi-ply ECL has thickness, and as such, the layers or plies have different radii of curvature when the label is affixed to a curved surface. Consequently, the upper ply will attempt to stretch, or more commonly, the base ply will buckle; or as also happens, the opposing edges of the entire label will lift away from the container. This is particularly the case when the multi-ply ECL label wraps around a significant portion of the container's perimeter. Accordingly, it is desirable to provide an ECL construction that reduces or eliminates the likelihood that wrinkling, buckling, or label lifting will occur when the multi-ply ECL label is applied to a curved, non-planar, and/or deformable surface, such as a cylindrical bottle or squeeze tube.

Fourth, as previously mentioned, the current designs for multi-ply ECL labels depict the base ply as being coextensive with the upper ply, with the occasional exception of a relatively small peel-tab structure. Often, a single label is applied to a bottle or tube such that the label wraps around almost the entire container. The printed text and graphics on the label are typically divided into two panels, a front panel with display graphics, and a back panel with informational text. The use of a single label rather than the application of two separate labels, one for the front and one for the back, has various advantages relating to costs and production efficiencies. Current ECL multi-ply designs with coextensive upper and base plies require a double thickness of label layers throughout substantially the entire length and width of the label. This often-unnecessary use of two plies on the front panel of a container can cause several problems. First, the exposed edges of the label perimeter have trace amounts of adhesive as a result of die cutting during the forming process of the label as well as a natural adhesive "ooze" or flow from between the two plies which occurs over time. This exposed adhesive can attract dust and dirt, rendering the front panel of the label unattractive and less apt to be sold. Secondly, the unneeded double thickness of the label material in the front panel area can affect handling such as reducing squeeze characteristics on a conformable tube. Accordingly, it is desirable to provide an ECL construction that reduces or eliminates the need for a multi-ply ECL to be substantially coextensive, allowing for a label with one display panel being one-ply while a second panel is two-ply.

SUMMARY OF THE INVENTION

The present invention provides a peel-back, re-sealable, printed multi-ply label including a base ply and an upper ply, in which the base ply and upper ply are substantially coextensive in one portion to form a two-ply panel, and in which the upper ply extends beyond the base ply in at least one direction to form a single-ply panel. To this end, the upper ply includes a first portion releasably affixed to the base ply by a pressure sensitive adhesive coating on the upper ply's underside or lower surface. The upper ply further includes a second portion extending beyond the base ply, and adapted to be secured, preferably permanently, to the surface of a container such as a bottle or squeeze tube, by a pressure sensitive adhesive coating on its lower surface. Prior to application of the label to a container, the second portion may be releasably secured to a release coated liner by means of the coating of pressure sensitive adhesive on its underside.

As with the both portions of the upper ply, the base ply is also coated with a pressure sensitive adhesive on substantially its entire underside surface by which the base ply may be releasably bonded to the release liner prior to application onto a container and substantially permanently bonded to the container after application. Additionally, the base ply is coated on its upper surface with a release agent to reduce the bonding force between the base ply and the pressure sensitive adhesive coating on the lower surface of the upper ply. This release coating allows the first portion of the upper ply to be peeled back from the base ply for viewing of printed graphics and text that are otherwise hidden.

Again, the pressure sensitive adhesive coatings on the lower surfaces of the second portion of the upper ply and the base ply releasably secure the multi-ply label to a release liner prior to application to a container, and substantially permanently bond the second portion of the upper ply and the base label to the surface of the container after application.

As the upper ply is peeled back for viewing, the second portion of the upper label, being substantially permanently attached to the container's surface, acts as a living hinge. This substantial hinge enables the upper ply to be peeled back numerous times and subsequently reclosed after each opening in perfect register with the original placement of the upper ply. In an exemplary embodiment, an edge portion of the base ply may be free of the release coating adjacent the second portion of the upper ply. The hinge is thereby extended slightly onto the base ply whereby to further ensure that the multi-ply label may be removed from the release liner and applied to the container as a one-piece multi-ply construction rather than as a separate upper ply and base ply.

The upper and lower plies of the label are advantageously made of a flexible material, such as flexible synthetic film or paper, clear or opaque, and more advantageously of a conformable material, such as the plastic films. Also, any or all of the upper and lower surfaces of both the upper label ply and the base label ply may be printed with desired text and graphic content, and advantageously, at least those surfaces not adapted to be permanently adhered to the container include printed matter.

The upper label material is advantageously a plastic film having a pressure-sensitive adhesive on its lower side. A web of release coated paper or film liner carries the entire label construction normally as a stream of labels wound into a roll. The labels are eventually removed from the liner and applied to the containers, such as bottles or tubes.

It is also appreciated that the size and shape of the labels of this invention can vary based on such factors as may be dictated by container size and shape or other artistic or practical requirements. The containers contemplated for use of this invention may be flat, curved, faceted, or non-planar. They may be ridged, semi-ridged or deformable, being formed out of any of the materials known in the packaging industry for forming such containers.

It is also appreciated that special peel-tabs can be incorporated into the label designs. For example, a peel-tab area may be formed by deadening the adhesive on the upper label layer in a selected "peel here" area, a well-known industry practice. Also, extensions of the upper ply beyond the base ply can be used in forming a peel-tab.

It is further appreciated that the upper ply can be partially coated on its lower side with adhesive deadeners, to lessen or eliminate the tacky, bonding properties of the pressure sensitive adhesive present on the lower side of the upper ply, a well known practice in the industry. Additionally, the upper ply may contain a score or perforation cut in order for the user to remove a portion of the upper ply as would be desired with a coupon or return-response sheet.

The present invention further provides a method of making multi-ply labels of the present invention in a single press pass and in a manner providing strict registration between plies. To this end, using a roll feed label press, an upper label web comprising the upper label ply carried on a temporary release liner is unwound and fed through printing stations of the press to apply printed text to the upper and lower surfaces of the upper ply. The printing process includes delamination of the upper ply from the temporary release liner to expose the lower surface for printing, followed by relamination to the liner. Optionally, an adhesive deadener may be applied to portions of the lower surface. A lower label web comprising the base label ply carried on a release liner is also unwound and fed through printing stations of the press to apply printed text and a release coating to the upper surface of the base ply. Both the upper and lower webs are then fed into die cut stations of the press where the base ply is die cut and the waste material removed, and the upper ply is split from the temporary liner and the liner is discarded. The upper ply is then joined to the base ply and the upper ply is die cut through to the release liner thereby also cutting any base ply in the cutting path. Waste material is discarded, and the multi-ply label is wound into a roll for storage and future use. The steps of the method of the present invention are carried out in a single pass through the roll feed label press, thereby providing simplified method of production that minimizes material waste and production labor while maintaining strict registration between plies.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

FIG. 8 is a perspective view a multi-ply label of a second embodiment prior to attachment to a container, with the upper ply in a closed configuration.

FIG. 9 is a cross-sectional view of the label of FIG. 8 taken along line 9—9.

FIG. 10 is perspective view of the label of FIG. 8 with a portion of the upper ply peeled away from the base ply in an open configuration.

FIG. 11 is a cross-sectional view of the label of FIG. 10 taken along line 11—11.

DETAILED DESCRIPTION OF INVENTION

The present invention provides a peel-back, re-sealable multi-ply label in which a first portion of an upper ply is substantially coextensive with a base ply to form a two-ply panel, and in which a second portion of the upper ply extends beyond the base ply in at least one direction to form a single-ply panel. The lower surfaces of the base ply and the second portion of the upper ply are adapted to be substantially permanently attached to a container surface by a pressure-sensitive adhesive. The lower surface of the first portion of the upper ply is coated with a pressure sensitive adhesive and is releasably bonded to the base ply by a release coating on the base ply, enabling the first portion to be peeled back and subsequently resealed. The multi-ply label of the present invention improves on prior art multi-ply designs for at least the following reasons. First, the label of the present invention does not require the application of a patterned release coat on the base ply to provide a living hinge. Second, the hinge between the upper ply and base ply during opening and closing is much stronger than prior designs by virtue of the entire, preferably large, second portion of the upper ply serving as the hinge by being substantially permanently bonded to the container, rather than the upper ply being secured to the typically small edge area of the base ply as taught in the prior art. Third, when applied to a curved and/or non-planar container, the label of the present invention, with its relatively small two-ply label section (formed by the base ply and a first portion of the upper ply) in comparison to the overall label size lessens or eliminates the undesired wrinkling, buckling, or lifting away from the container, such as is seen with fully two-layer multi-ply labels as taught in prior art. Fourth, the present invention allows for a substantially full wrap label, creating a container with both a front and back printed panel, but with only one of the panels being multi-ply. For example, the front label section can be of a single-ply thickness, eliminating undesired attributes of excessive stiffness when applied on conformable containers, and also solving the issue of dirt and dust buildup which can occur from adhesive ooze in the fully two-ply labels of prior designs.

Figure 1:
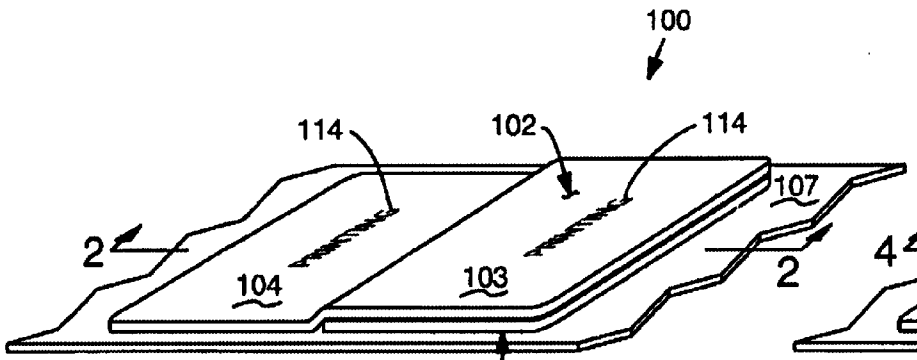
FIG. 1 is a perspective view a multi-ply label of a first embodiment prior to attachment to a container, with the upper ply in a closed configuration.
Figure 2:
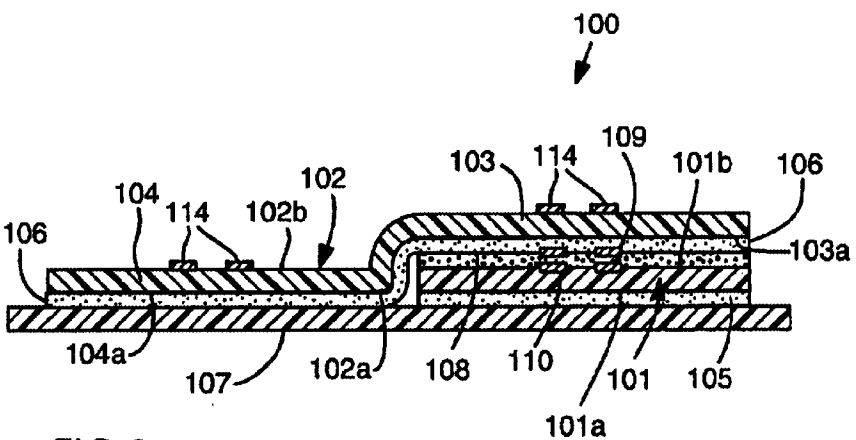
FIG. 2 is a cross-sectional view of the label of FIG. 1 taken along line 2—2.

Referring now to the figures in which like reference numerals are used to refer to like parts, and with specific reference to FIGS. 1–2, a label according to a first embodiment of the present invention, generally denoted by the numeral 100, is shown in perspective view and cross-sectional view, respectively. Label 100 includes a base ply 101, and an upper ply 102. The upper ply 102 includes a first portion 103 (hereafter referred to as "upper ply first portion 103") and a second portion 104 (hereafter referred to as "upper ply extended second portion 104"). The base ply 101 is coated on its lower surface 101*a* with a pressure sensitive adhesive 105 and the upper ply 102 is also coated with a pressure sensitive adhesive 106 on its lower surface 102*a*, which includes a lower surface 103*a* of upper ply first portion 103 and a lower surface 104*a* of upper ply extended second portion 104. Label 100 may be releasably secured to a release liner 107 by the pressure sensitive adhesive 105 and that portion of the pressure sensitive adhesive 106 on lower surface 104*a* that is in contact with release liner 107. Although only one label 100 is shown positioned on the release liner 107, preferably a series of labels 100 are aligned along an extended length of release liner 107, both liner and labels being formed into a reel or roll for storage and future application to a container.

Upper ply first portion 103 is releasably bonded to an upper surface 101*b* of the base ply 101 by that portion of pressure sensitive adhesive 106 positioned on the lower surface 103*a* of the upper ply first portion 103. A release coating 108 covers the upper surface 101*b* of the base ply 101 to allow the upper ply first portion 103 to be peeled back from the base ply 101 for viewing of printed graphics and text 109, 110, hereafter referred to as "printed matter," which are otherwise hidden, as discussed in more detail below.

The upper ply extended second portion 104 extends beyond the base ply 101 in at least one direction such that the lower surface 104*a* thereof is adapted to be affixed to a liner or container. Prior to application of the label 100 to a container, this upper ply extended second portion 104 is releasably secured to release liner 107 by the pressure sensitive adhesive 106 on its lower surface 104*a*. After application of label 100 to a container, the adhesive 106 secures, preferably substantially permanently, the upper ply extended second portion 104 to the surface of a container, such as a bottle or squeeze tube.

Figure 3:
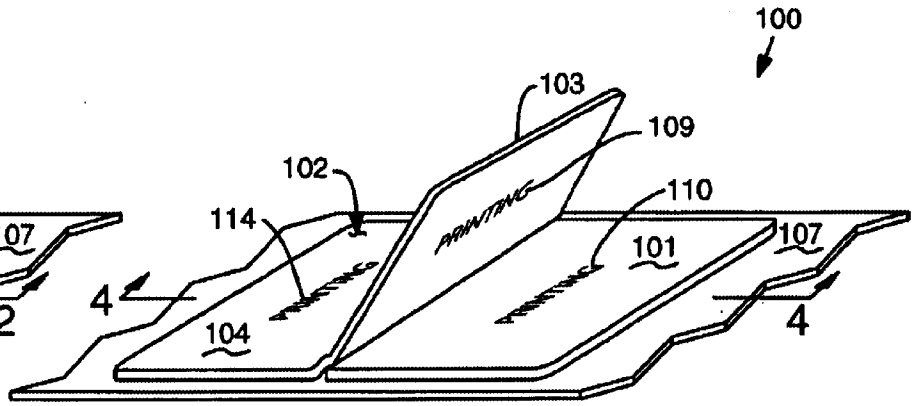
FIG. 3 is perspective view of the label of FIG. 1 with a portion of the upper ply peeled away from the base ply in an open configuration.
Figure 4:
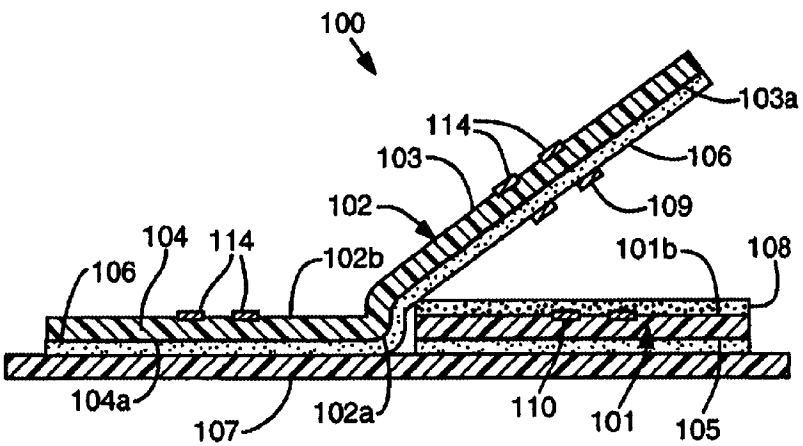
FIG. 4 is a cross-sectional view of the label of FIG. 3 taken along line 4—4.

Referring to FIGS. 3–4 the label 100 is shown, still affixed to the release liner 107, but with the upper ply first portion 103 being peeled back from the base ply 101 as would be done in order to view any printed matter 109 located on the lower surface 103*a* of upper ply first portion 103 and/or any printed matter 110 located on the upper surface 101*b* of base ply 101. The printed matter 110 on the base ply 101 is preferably located below, and is protected by a clear release coating 108. The printed matter 109 on the lower surface 103*a* of upper ply first portion 103 is typically printed directly onto the pressure sensitive adhesive 106. Printed matter 114 may also be included on upper surface 102*b* of upper ply 102.

Figure 5:
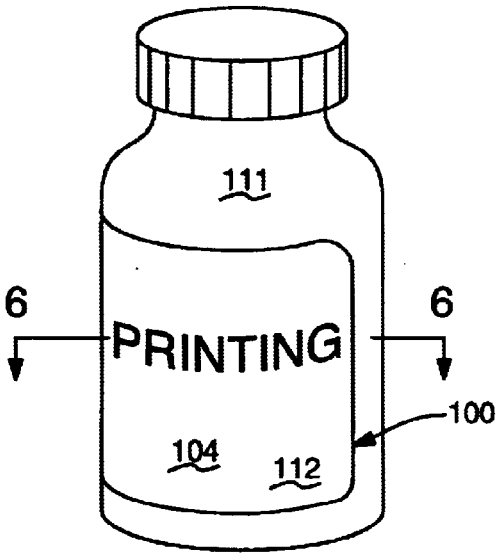
FIG. 5 is a perspective view of the label of FIG. 1 as applied to a curved container.
Figure 6:
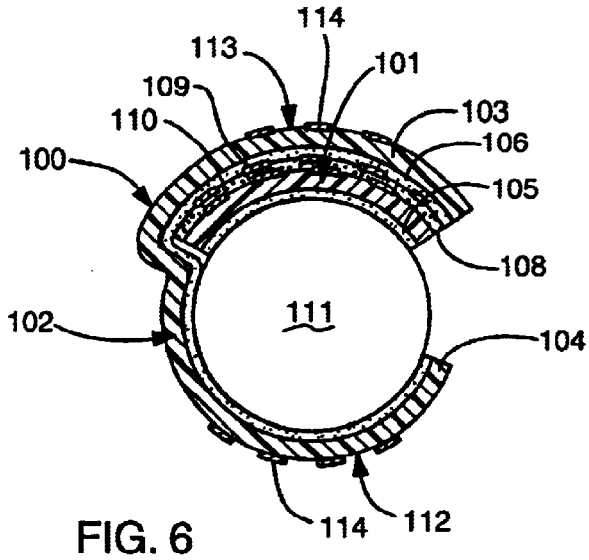
FIG. 6 is a cross-sectional view of the label and container of FIG. 5 taken along line 6—6, with the label shown in a closed configuration.
Figure 7:
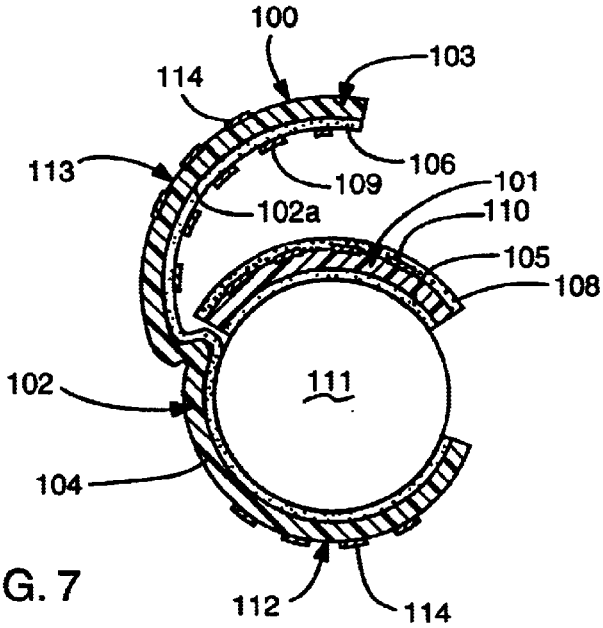
FIG. 7 is a cross-sectional view similar to that depicted in FIG. 5, but with the label shown in an open configuration.

Referring to FIGS. 5–7, the label 100 is shown having been removed from the release liner 107 and subsequently affixed to a curved and/or non-planar container such as a plastic bottle. As is shown in cross section in FIG. 6, the label 100 advantageously wraps around a significant portion of the container's perimeter to provide both a front panel 112 and back panel 113 to display printed matter. It may be appreciated that the front panel 112 of label 100 may be formed from a single ply of plastic or paper material and that the back panel 113 may be formed substantially from two plies of either plastic and/or paper materials.

FIG. 6 shows label 100 applied and affixed to the curved surface of a bottle 111 with the two-ply back panel 113 in a closed configuration wherein upper ply first portion 103 is in substantially full contact with the base ply 101. When label 100 is applied onto the curved surface of bottle 111, the base ply 101 and the upper ply first portion 103 change in several notable ways. First, the label 100, shown as basically flat in FIGS. 1–4, is now curved, taking on the contours of the perimeter of the bottle 111. The base ply 101 and the upper ply first portion 103, which are releasably bonded together by the pressure sensitive adhesive 106 coated on the lower surface 103*a* of upper ply 102, now have radius dimensions in which the base ply 101 has a smaller radius than the upper ply first portion 103. This difference in radii will result in the base ply 101 tending to assume a smaller dimensional length in the direction of the bottle perimeter as compared to the length of the associated upper ply first portion 103 to which it is bonded, a situation where unwanted wrinkling, buckling, or lifting of the label plies is often of concern. However, the relatively small length of the base ply 101 along with its associated upper ply first portion 103 greatly reduces or eliminates the likelihood of wrinkling, buckling, or label lifting as compared to labels of the prior art in which the entire perimeter length of the label has two plies of differing radii.

FIG. 7 shows label 100 applied and affixed to the curved surface of the bottle 111 with the back panel 113 in an open configuration wherein upper ply first portion 103 is peeled back from the base ply 101 to expose the printed matter 109 and 110. As the upper ply first portion 103 is peeled back, the bond between the pressure sensitive adhesive 106 on the upper ply first portion 103 and the release coating 108 on the base ply 101 is temporarily broken. During this peel-back process, the upper ply extended second portion 104, being substantially permanently attached to the surface of bottle 111 acts as a living hinge. The substantial hinge formed by the upper ply extended second portion 104 enables the upper ply first portion 103 to be peeled back numerous times and subsequently reclosed after each opening in perfect register as compared to the original placement of the upper ply 102. Both the relatively large size and permanence of bonding to the bottle 111 surface render the upper ply extended second portion 104 a superior method of hinging as compare to prior art discussed herein where only the edge of the upper ply is permanently bonded to the edge of the base ply.

It will be appreciated, based on individual preferences, that what is shown in FIGS. 5–8 as being the single-ply front panel 112 of a container, with associated graphics and text, could just as simply have been printed with different graphics or text and thereby serve instead as the back panel of the container. Similarly, a change in the printed matter could render the two-ply back panel 113 as the front panel of the container when displayed, for example on a store shelf, if desired.

As shown in the exemplary embodiment of FIGS. 1–7, the upper ply first portion 103 is substantially coextensive with the base ply 101. The upper ply extended second portion 104 is advantageously of significant dimension in length and width to provide a strong bonding force for the hinge. For example, as shown, upper ply extended second portion 104 is of equal size to the upper ply first portion 103, thereby providing front and back panels 112 and 113 of equal size. However, it may be understood that the sizes of the plies may be varied as desired by the customer.

Now turning to FIGS. 8–14, a second embodiment of a label of the present invention is shown therein. It is the inventors' purpose in providing this second embodiment to include and discuss various contemplated forms the invention could take, as example only. As such, a multi-ply label for application to a non-planar squeeze tube is used for exhibit and discussion. The use of a crimped squeeze tube, common to the packaging industry, is relevant in that it demonstrates certain advantages of labels of the present invention when applied to deformable containers.

With reference to FIGS. 8–9, a label according to a second embodiment of the present invention, generally denoted by the numeral 200, is shown therein. Label 200 includes a base ply 201, and an upper ply 202. The upper ply 202 includes a first portion 203 (hereafter referred to as "upper ply first portion 203") and a second portion 204 (hereafter referred to as "upper ply extended second portion 204"). The base ply 201 is coated on its lower surface 201*a* with a pressure sensitive adhesive 205 and the upper ply 202 is also coated with a pressure sensitive adhesive 206 on its lower surface 202*a*, which includes a lower surface 203*a* of upper ply first portion 203 and a lower surface 204*a* of upper ply extended second portion 204. Label 200 may be releasably secured to a release liner 207 by the pressure sensitive adhesive 205 and that portion of the pressure sensitive adhesive 206 on lower surface 204*a* that is in contact with release liner 207. Although only one label 200 is shown positioned on the release liner 207, preferably a series of labels 200 are aligned along an extended length of release liner 207, both liner and labels being formed into a reel or roll for storage and future application to a container.

Upper ply first portion 203 is releasably bonded to an upper surface 201*b* of the base ply 201 by that portion of pressure sensitive adhesive 206 positioned on the lower surface of the upper ply first portion 203. A pattern release coating 208 covers a majority of the upper surface 201*b* of the base ply 201 to allow the upper ply first portion 203 to be almost completely peeled back from the base ply 201 for viewing of printed matter 209, 210 which is otherwise hidden. An edge portion 218 of base ply 201 is left uncoated, as will be described further below.

The tacky, bonding characteristics of pressure sensitive adhesive 206 positioned on the lower surface 203*a* of the upper ply first portion 203 are modified by the application of a clear adhesive deadener or varnish 214, which are printed coatings well known in the industry. The adhesive deadening coating 214 lessens the amount or force of bonding between the upper ply first portion 203 and the base ply 201. The deadening coating 214 is preferably applied as a full coverage coating, but alternatively can be applied as a screen or other desired intermittent pattern. Advantageously, as is shown, selected sections of the adhesive 206 on the upper ply first portion 203 are left undeadened to allow for a more aggressive bonding of the upper ply first portion 203 to the base ply 201 when the label is in its closed configuration. Additionally, to aid in holding the upper ply first portion 203 to the base ply portion 201 during application to a container, this embodiment shows the release coating 208 having a pattern wherein the coating coverage falls short on the base ply 201 at one edge 218 to form an uncoated, non-release edge portion on the upper surface 201*b*. As shown, the adhesive 206 can help secure the upper ply first portion 203 to the base ply edge 218 by the bonding nature of adhesive 206 that occurs in this uncoated, non-release edge portion 218 of the base ply 203. In effect, the hinge formed between upper ply extended second portion 204 and the container surface (not shown) is extended slightly to include edge 218 of the base ply 201.

The upper ply extended second portion 204 extends beyond the base ply 201 in at least one direction such that the lower surface 204*a* thereof is adapted to be affixed to a liner or container. Prior to application of the label 200 to a container, this upper ply extended second portion 204 is releasably secured to release liner 207 by the pressure sensitive adhesive 206 on its lower surface 204*a*. After application of label 200 to a container, the adhesive 206 secures, substantially preferably permanently, the upper ply extended second portion 204 to the surface of a container, such as a squeeze tube.

The upper ply 202 of label 200 includes a third portion defining a peel-tab 215 which extends beyond the base ply 201, preferably beyond the opposite edge 219 of the base ply 201 from which the upper ply extended second portion 204 extends, i.e., opposite the edge 218. It is appreciated that the size, shape, and exact location of the peel-tab 215 may vary as to better suit user preferences. An adhesive deadener 216 is preferably applied to the lower surface 215*a* of peel-tab 215 to facilitate ease of use.

The conformable material is advantageously used for both the base ply 201 and the upper ply 202, for example a conformable polyolefin pressure sensitive stock, such as Avery Dennison's 2.5 mil. product #74010 or 3.5 mil. product #75495. Polyolefin films work well in that they are relatively conformable, which is an important attribute when labeling squeeze tubes where stiffer films might wrinkle or buckle as the tube is handled and squeezed. Other even more conformable films such as polyethylene as well as less conformable films such as polypropylene, polystyrene, polyester and polyvinyl chloride are also contemplated. Indeed, a wide variety of paper and synthetics may be used within the scope of the present invention. It may also be appreciated that a different material may be used for the upper ply 202 than for the base ply 201. For example, a more conformable material may be used for the upper ply 202 which may be subject to repeated opening and closing by a consumer.

Referring to FIGS. 10–11, the label 200 is shown, still affixed to the release liner 207, but with the upper ply first portion 203 being peeled back from the base ply 201 as would be done in order to view any printed matter 209 located on the lower surface 203*a* of upper ply first portion 203 and/or any printed matter 210 located on the upper surface 201*b* of base ply 201. The printed matter 210 on the base ply 201 is preferably located below, and is protected by, a clear release coating 208. The printed matter 209 on the lower surface 203*a* of upper ply first portion 203 is typically printed directly onto the pressure sensitive adhesive 206. Alternatively, the printed matter 209 can be, if desired, printed on top of adhesive deadener 214, if such a deadener 214 is located in the area of such printed matter. Printed matter 217 may also be included on upper surface 202*b* of upper ply 202.

Figure 13:
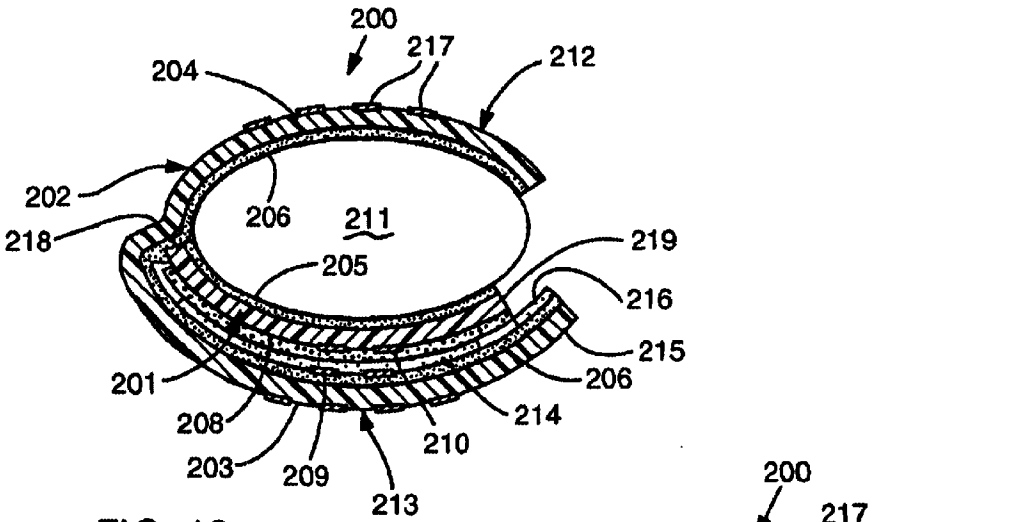
FIG. 13 is a cross-sectional view of the label and container of FIG. 12 taken along line 13—13, with the label shown in a closed configuration.
Figure 14:
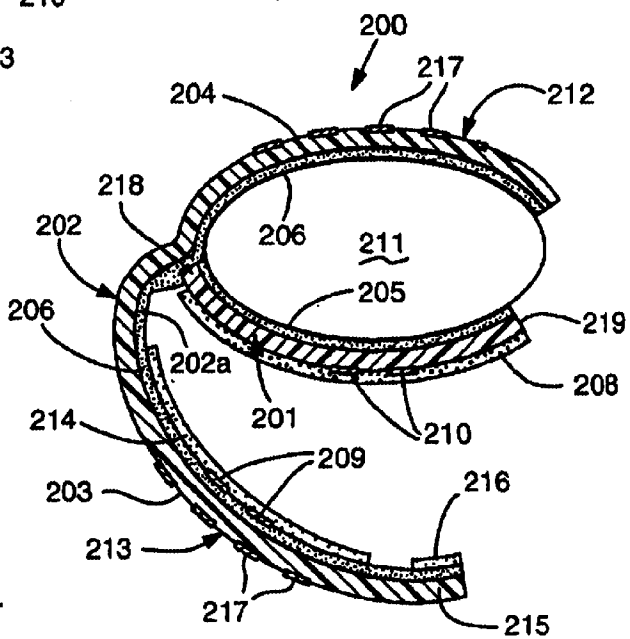
FIG. 14 is a cross-sectional view similar to that depicted in FIG. 13, but with the label shown in an open configuration.
Figure 12:
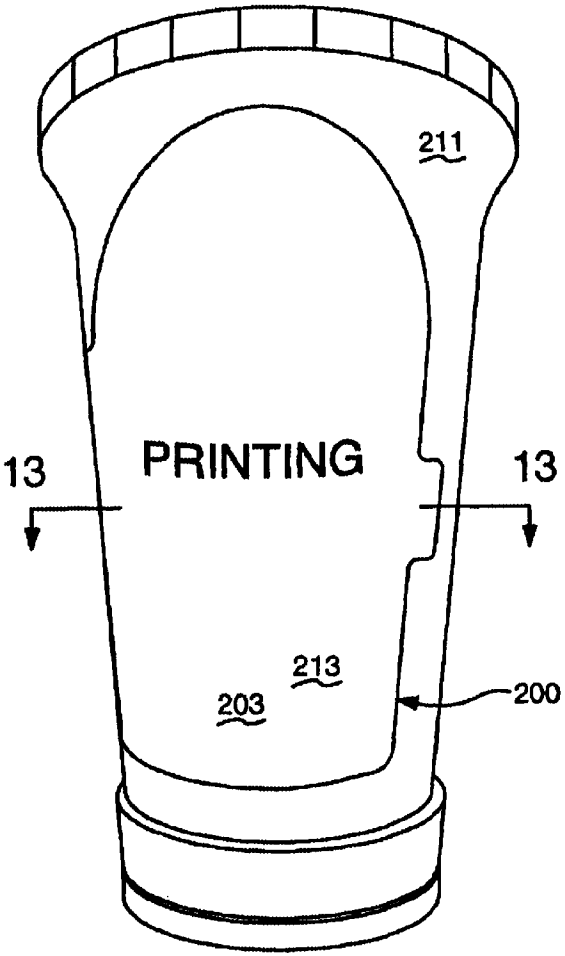
FIG. 12 is a perspective view of the label of FIG. 8 as applied to a curved, non-planar container, such as a squeeze tube with a crimped end.

Referring to FIGS. 12–14, the label 200 is shown having been removed from the release liner 207 and subsequently affixed to a plastic squeeze tube 211 that is round or oval at one end and crimped or flat at the other end, such non-planar, deformable tubes 211 being common in the packaging industry. Label 200 may be formed by die cutting methods common to the trade with a special shape as might be preferred by the user. It is appreciated that many appropriate shapes or sizes can be incorporated into the present invention. As is shown in cross section in FIG. 13, the label 200 advantageously wraps around a significant portion of the squeeze tube perimeter to provide both a front panel 212 and back panel 213 to display printed matter. It may be appreciated that the front panel 212 of label 200 may be formed from a single ply of material and that the back panel 213 may be formed substantially from two plies of material. FIG. 12 depicts the label 200 as it would appear when viewing the two-ply back panel 213.

FIG. 13 shows label 200 applied and affixed to the curved and non-planar surface of squeeze tube 211 with the two-ply back panel in a closed configuration wherein upper ply first portion 203 is in substantially full contact with the base ply 201. When label 200 is applied onto the curved and non-planar surface of squeeze tube 211, the base ply 201 and the upper ply first portion 203 change in several notable ways. First, the label 200, shown as basically flat in FIGS. 8–11, is now curved, taking on the contours of the perimeter of the squeeze tube 211. The base ply 201 and the upper ply first portion 203, which are releasably bonded together by the pressure sensitive adhesive 206 coated on the lower surface 202*a* of upper ply 202, now have radius dimensions in which the base ply 201 has a smaller radius than the upper ply first portion 203. This difference in radii will result in the base ply 201 tending to assume a smaller dimensional length in the direction of the tube's perimeter as compared to the length of the associated upper ply first portion 203 to which it is bonded, a situation where unwanted wrinkling, buckling or lifting of the label plies is often of concern. However, the relatively small length of the base ply 201 with its associated upper ply first portion 203 greatly reduces or eliminates the likelihood of wrinkling, buckling, or label lifting as compared to labels of the prior art in which severe stresses would occur where the entire perimeter length of the label has two plies of differing radii. Additionally, the squeeze tube 211 back surface is relatively flat along the majority of its area, minimizing the effects of different radii plies positioned thereon. Finally, the conformable materials advantageously used for forming both plies, such as conformable plastics, will tend to allow for minor radii differences as shown in this embodiment.

FIG. 14 shows label 200 applied and affixed to the curved and non-planar surface of the tube 211 with the back panel 213 in an open configuration wherein upper ply first portion 203 is peeled back from the base ply 201 to expose the printed matter 209 and 210. As the upper ply first portion 203 is peeled back, such as by lifting up peel-tab 215, the bond between the pressure sensitive adhesive 206 on the upper ply first portion 203 and the release coating 208 on the base ply 201 is temporarily broken. A reduced tackiness of adhesive 206 is exhibited in areas coated with the adhesive deadener 214, 216. During this peel-back process, the upper ply extended second portion 204, being substantially permanently attached to the surface of squeeze tube 211, acts as a living hinge, as does the uncoated edge portion 218 of base ply 201. The substantial hinge formed by the upper ply extended second portion 204 enables the upper label to be peeled back numerous times and subsequently reclosed after each opening in perfect register as compared to the original placement of the upper ply first portion 203. Both the relatively large size and the permanence of bonding to the squeeze tube 211 surface render the upper ply extended second portion 204 a superior method of hinging as compared to prior art discussed herein where only the edge of the upper ply is permanently bonded to the edge of the base ply.

It will be appreciated, based on individual preferences, that what is shown in FIGS. 12–14 as being the single-ply front panel 212 of a squeeze tube 211, with associated graphics and text, could just as simply have been printed with different graphics or text and serve instead as the back panel of the tube. Similarly, a change in the graphics or text could render the substantially two-ply section panel 213 as the front panel of the container when displayed, for example on a store shelf, if desired.

It is recognized as desirable to manufacture multi-layer labels in a manner that maintains strict registration between all printed matter and all die cutting (label perimeters). In addition, a method of production is desired that minimizes material waste and production labor. Accordingly, the present invention allows for the complete manufacture of the multi-layer labels described herein using a "single press pass" instead of a sequence of separate operations, as is common in prior methods. This process can be accomplished using primarily standard roll-fed label presses, as are common in the industry, produced by companies such as Nilpeter, Mark Andy, and Arsoma. Relatively minor modifications in accordance with the present invention include the use of readily available press additions such as an extra stock unwind, turn bars, a delamination-relamination apparatus and assorted extra support rollers, all commonly used and available tools in the label manufacturing industry.

Figure 15:
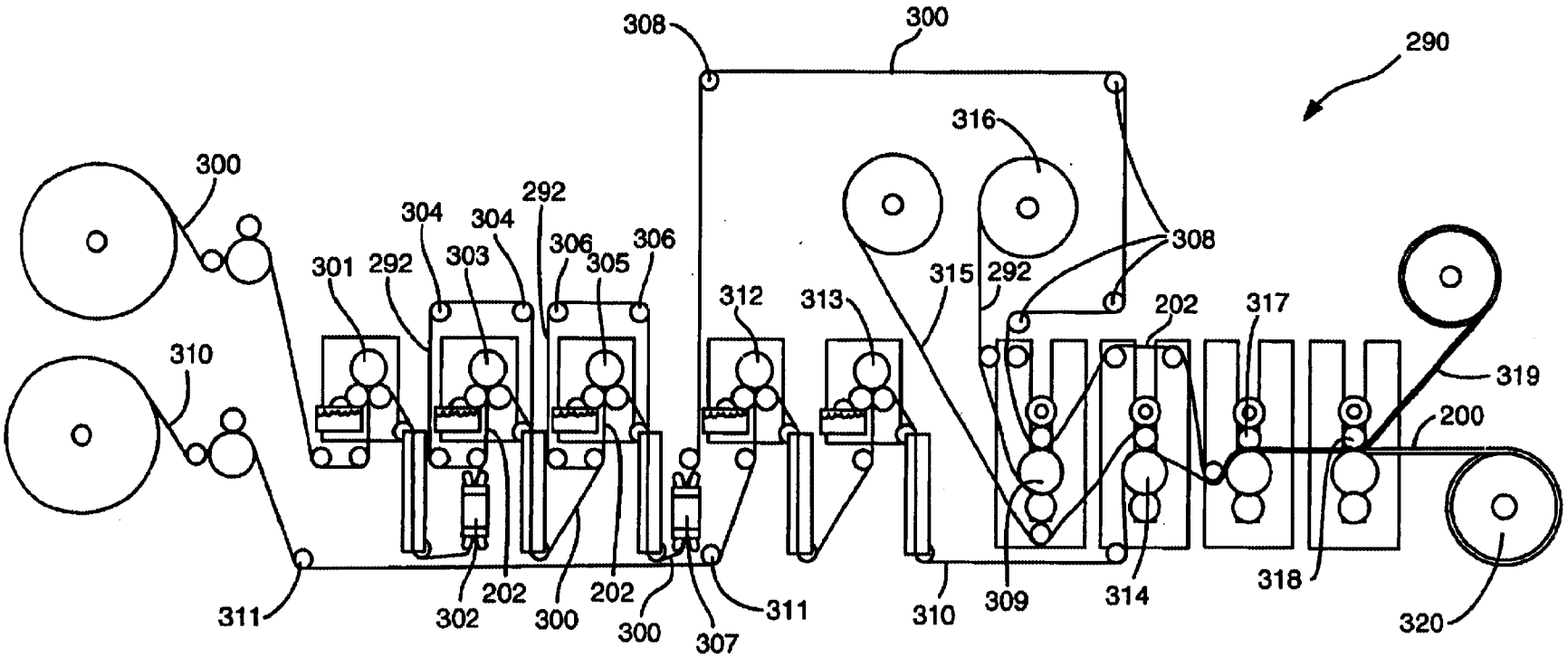
FIG. 15 depicts in schematic view an exemplary apparatus and method for making a label in accordance with the present invention.

Referring to FIG. 15, in a process for making labels in accordance with the present invention, a web 300 defining a series of upper labels is unwound and introduced into a printing section of a roll-fed label press 290. For ease of discussion, the method will be described with reference to the manufacture of label 200 depicted in FIGS. 8–14. It should be understood, however, that the method is applicable for any label of the present invention. The web 300 is preferably composed of a plastic film upper ply 202 with a pressure-sensitive adhesive 206 on its underside or lower surface 202*a*, with said film and adhesive removably affixed to a temporary paper or film release support liner 292, which said liner 292 will later be discarded during the process. This upper label web 300 is printed on its upper surface 202*b* with the desired printed matter 217. Although FIG. 15 shows one print station 301 for printing on the upper surface 202*b* of the upper web 300, it is appreciated that a series of print stations would be required if multiple colors or protective coatings were desired on the upper surface 202*b* of the upper web 300.

After all desired printing has been performed on the upper surface 202*b* of the upper web 300, the web is flipped over using a turnbar apparatus 302, as is common in the industry. The web 300 is then "split" into two webs by temporarily separating the plastic film 202 with its adhesive coating 206 from the liner 292. The newly exposed adhesive coating 206 of the upper ply 202 is then printed with desired printed matter 209 or a coating using print station 303. The separated liner web 292 is diverted around the print station 303 using a series of rollers collectively termed a delamination-relamination apparatus 304, which units are of common use in the industry. The liner 292 and plastic film 202 with its newly printed upon adhesive are then recombined into the single web 300.

If desired, additional colors or coatings can be printed on the upper label adhesive 206 by repeating the steps of delamination-print-relamination as previously described. For example, print station 305 is shown with its associated delamination-relamination apparatus 306, for printing an adhesive deadener 214 and 216 on the once-again exposed adhesive 206 of the upper label 202. The liner 292 is then rejoined to the plastic film 202 and held in place by the non-deadened areas of adhesive 206 on the upper label film 202.

The upper web 300, now printed as desired, is again "flipped" using a second turnbar 307 such that the web 300 is in its original posture with the plastic film 202 on top, and the liner 292 on the bottom. The upper web 300 is then diverted past the remaining print stations 312, 313 by use of a series of elevated rollers 308 and is fed into the first die cut section of the press via a print pacing roll 309.

A lower web 310 defining a series of label base layers is concurrently unwound into the same label press. This web 310 is also preferably composed of a plastic film base ply 201 with a pressure-sensitive adhesive 205 on its underside or lower surface 201*a* and has a release support liner 207. Unlike the upper web liner 292, the lower web liner 207 will not be discarded as waste, but rather will remain as a support web for the final multi-ply labels 200 which are normally kept in rolls until used.

The lower web 310 is diverted past those stations 301, 303, 305 used in printing the upper web 300 by a series of rollers 311 and is then fed into one or more print stations 312 to print text 210 on the upper surface 201*b* of the plastic base layer 201. A final print station 313 prints the release coating 208, enabling the finished multiply label 200 to be opened and viewed.

Next, the lower web 310 is fed into a die cut station 314 where the web material is die cut through the plastic film 201 and adhesive 205, but not through the liner 207, to thereby form the basic shape of the base ply 201, which may be altered somewhat at a later stage, as will be described. Excess film and associated adhesive 206 not used in the formation of the base ply 201 is then stripped away as a waste matrix 315.

Prior to joining the two webs 300 and 310, the upper ply 202 of upper label web 300 is again "split" from the support liner 292, this time the liner 292 then being permanently removed from the film 202 and associated adhesive 206 and being rewound into a roll 316 for discarding. The remainder upper ply 202 of upper label layer web 300 with its now exposed adhesive 206 on its lower surface 202*a* is then joined by a lamination roll 317 to the base layer web 310 which now has excess material removed as described above. Another die cut station 318 forms the perimeter shape of the upper ply 202. This die cut extends through both the upper ply 202 and any of the base ply 201 that is in the path of the die cut. It does not cut through the base label release support liner 207. Thus, this second die cut can alter the shape of the base ply 201 and make the upper and lower plies 202, 201 coextensive where the second die cut is in the path of the base label ply 201. Finally, the excess upper ply and base ply material is stripped away as waste matrix 319, leaving the final multi-ply labels 200 on a support liner 207 to be wound into a roll 320 for storage and eventual use. By this method, a single pass of the label plies through the roll-fed label press produces labels according to the invention in a manner that achieves strict registration between plies and minimizes material waste and production time and labor.

While the present invention has been illustrated by the description of one or more embodiments thereof, and while those embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of Applicant's general inventive concept.

What is claimed is:

1. A peel-back, re-sealable multi-ply label comprising:

a base ply having an upper surface and a lower surface adapted to be attached to a container surface; and an upper ply having an upper surface and a lower surface, and having a first portion releasably bonded on said lower surface to at least a portion of said upper surface of said base ply and a second portion extending beyond said base ply in at least one direction and having said lower surface adapted to be substantially permanently attached to said container surface.

2. The label of claim 1 wherein said upper ply and said base ply comprise a conformable material and remain conformable when attached to a deformable container surface.

3. The label of claim 2 wherein said conformable material is a plastic film.

4. The label of claim 1 wherein said upper ply further includes a pressure-sensitive adhesive coating covering substantially all of said lower surface of both said first and second portions.

5. The label of claim 4 wherein said base ply further includes a release coating covering substantially all of said upper surface to provide said releasable bond.

6. The label of claim 5 wherein said upper ply further includes an adhesive deadening coating covering a portion of said adhesive coating on said lower surface of said first portion.

7. The label of claim 6, wherein said release coating covers substantially all of said upper surface of said base ply except for an edge portion adjacent said second portion of said upper ply whereby said lower surface of said first portion of said upper ply is substantially permanently bonded to said edge portion of said base ply.

8. The label of claim 1 wherein said lower surfaces of said base layer and said second portion of said upper layer are releasably attached to a liner by a pressure-sensitive adhesive.

9. The label of claim 1 wherein said base layer and said second portion of said upper layer are attached to a container surface that is at least one of non-planar, deformable or curved.

10. The label of claim 1 wherein said base ply and said first portion of said upper ply are substantially coextensive.

11. The label of claim 10 wherein said first portion of said upper ply is approximately equal in size to said second portion of said upper ply.

12. The label of claim 1 further comprising printed matter on said upper surfaces of said upper ply and said base ply.

13. The label of claim 1 further comprising printed matter on said upper surfaces of said upper ply and said base ply and on said lower surface of said first portion of said upper ply.

14. The label of claim 1 further comprising a non-tacky peel-tab area on said lower surface of said first portion of said upper label to facilitate lifting of said upper ply from said lower ply.

15. A peel-back, re-sealable multi-ply label comprising:

(a) a base ply having an upper surface and a lower surface, wherein said upper surface includes an un-coated edge portion and a coated portion having a release coating thereon, and wherein said lower surface includes a pressure-sensitive adhesive coating for securing said base ply to a container surface; and (b) an upper ply comprising first and second portions, each having an upper surface and a lower surface, wherein said lower surfaces include a pressure-sensitive adhesive coating, and wherein a portion of said lower surface of said first portion is further coated with and adhesive deadener, and wherein said first portion of said upper ply is disposed over said upper surface of said base ply with said second portion of said upper ply adjacent said uncoated edge portion of said base ply, whereby said first portion of said upper ply is releasably bonded to said coated portion of said base ply and substantially permanently bonded to said uncoated edge portion, and wherein said second portion of said upper ply is adapted to be substantially permanently attached on said lower surface to said container surface by said pressure-sensitive adhesive coating.

16. The label of claim 15 wherein said upper ply and said base ply comprise a conformable material and remain conformable when attached to a deformable container surface.

17. The label of claim 16 wherein said conformable material is a plastic film.

18. The label of claim 15 wherein said lower surfaces of said base layer and said second portion of said upper layer are releasably attached to a liner by said pressure-sensitive adhesive.

19. The label of claim 15 wherein said base layer and said second portion of said upper layer are attached to a container surface that is at least one of non-planar, deformable or curved.

20. The label of claim 15 wherein said base ply and said first portion of said upper ply are substantially coextensive.

21. The label of claim 20 wherein said first portion of said upper ply is approximately equal in size to said second portion of said upper ply.

22. The label of claim 15 further comprising printed matter on said upper surfaces of said upper ply and said base ply.

23. The label of claim 15 further comprising printed matter on said upper surfaces of said upper ply and said base ply and on said lower surface of said first portion of said upper ply.

24. The label of claim 15 further comprising a non-tacky peel-tab area on said lower surface of said first portion of said upper label to facilitate lifting of said upper ply from said lower ply.

25. A peel-back, re-sealable multi-ply label comprising:

a base ply having an upper surface with printed matter thereon, and having a lower surface coated with a pressure-sensitive adhesive for securing said base ply to a container surface; and an upper ply having an upper surface with printed matter thereon, and having a lower surface coated with a pressure-sensitive adhesive, wherein a first portion of said upper ply is disposed over at least a portion of said upper surface of said base ply, and wherein a second portion of said upper ply is adapted to be substantially permanently attached on said lower surface to said container surface by said pressure-sensitive adhesive;

an adhesive deadening coating and a release coating between said upper surface of said base ply and said pressure-sensitive adhesive on said lower surface of said first portion of said upper ply, whereby said first portion of said upper ply is releasably bonded to said base ply.

26. The label of claim 25 wherein said upper ply and said base ply comprise a conformable material and remain conformable when attached to a deformable container surface.

27. The label of claim 26 wherein said conformable material is a plastic film.

28. The label of claim 25, wherein said release coating is between substantially all of said upper surface of said base ply and pressure-sensitive adhesive on said lower surface of said first portion of said upper ply except for an edge portion of said base ply adjacent said second portion of said upper ply whereby said lower surface of said first portion of said upper ply is substantially permanently bonded to said edge portion of said base ply.

29. The label of claim 25 wherein said lower surfaces of said base layer and said second portion of said upper layer are releasably attached to a liner by said pressure-sensitive adhesive.

30. The label of claim 25 wherein said base layer and said second portion of said upper layer are attached to a container surface that is at least one of non-planar, deformable or curved.

31. The label of claim 25 wherein said base ply and said first portion of said upper ply are substantially coextensive.

32. The label of claim 31 wherein said first portion of said upper ply is approximately equal in size to said second portion of said upper ply.

33. The label of claim 25 further comprising printed matter on said lower surface of said first portion of said upper ply.

34. The label of claim 25 further comprising a non-tacky peel-tab area on said lower surface of said first portion of said upper label to facilitate lifting of said upper ply from said lower ply.

35. A peel-back, re-sealable multi-ply label comprising:

a base ply comprising a conformable material and having an upper surface and a lower surface adapted to be attached to a deformable container surface that is at lease one of non-planar or curved; and an upper ply comprising a conformable material and having an upper surface and a lower surface, and having a first portion releasable bonded on said lower surface to at least a portion of said upper surface of said base ply and a second portion extending beyond said base ply having said lower surface adapted to be substantially permanently attached to said deformable container surface, wherein said upper ply and said base ply remain conformable when attached to said deformable container surface.

36. The label of claim 35 wherein said conformable material is a plastic film selected from the group consisting of: polyolefin, polyethylene, polypropylene, polystyrene, polyester and polyvinyl chloride.

37. The label of claim 35 wherein said upper ply further includes a pressure-sensitive adhesive coating covering substantially all of said lower surface of both said first and second portions.

38. The label of claim 37 wherein said base ply further includes a release coating covering substantially all of said upper surface to provide said releasable bond.

39. The label of claim 38 wherein said upper ply further includes an adhesive deadening coating covering a portion of said adhesive coating on said lower surface of said first portion.

40. The label of claim 38, wherein said release coating covers substantially all of said upper surface of said base ply except for an edge portion adjacent said second portion of said upper ply whereby said lower surface of said first portion of said upper ply is substantially permanently bonded to said edge portion of said base ply.

41. The label of claim 35 wherein said base ply and said first portion of said upper ply are substantially coextensive.

42. The label of claim 41 wherein said first portion of said upper ply is approximately equal in size to said second portion of said upper ply.

43. The label of claim 35 further comprising printed matter on said upper surfaces of said upper ply and said base ply.

44. The label of claim 35 further comprising printed matter on said upper surfaces of said upper ply and said base ply and on said lower surface of said first portion of said upper ply.

45. The label of claim 35 further comprising a non-tacky peel-tab area on said lower surface of said first portion of said upper label to facilitate lifting of said upper ply from said lower ply.

46. A method of manufacturing a plurality of multi-ply labels comprising the steps of:

unwinding an upper label web comprising a plurality of upper label plies, each having an adhesive on a lower surface thereof and carried on a first liner;

unwinding a base label comprising a plurality of base label plies, each having an adhesive on a lower surface thereof and carried on a second liner;

printing on an upper surface of said upper label plies;

delaminating said upper label plies and said first liner;

printing on said lower surface of said upper label plies;

combining said upper label plies and said first liner to again form said upper label web;

printing on an upper surface of said base label plies;

applying a release coating on said upper surface of said base label plies;

cutting said base label plies on said base label web and removing a waste matrix of said base label plies from said base label web;

delaminating and removing said first liner from said upper label plies;

combining said upper label plies with respective base label plies on said second liner of said base label web to form a multi-ply label web;

cutting said upper label plies on said multi-ply label web and removing a waste matrix of said upper label plies from said multi-ply label web; and conducting said steps in a single pass through a roll-fed label press.

* * * * *

UNITED STATES PATENT AND TRADEMARK OFFICE

CERTIFICATE OF CORRECTION

PATENT NO. : 6,752,431 B1
DATED : June 22, 2004
INVENTOR(S) : Matthews et al.

It is certified that error appears in the above-identified patent and that said Letters Patent is hereby corrected as shown below:

Column 1,
Line 20, “that” should be -- than --.

Column 3,
Line 35, “with the both” should be -- with both --.

Column 5,
Line 9, “FIG. 3 is perspective” should be -- FIG. 3 is a perspective --.
Line 27, “FIG. 10 is perspective” should be -- FIG. 10 is a perspective --.

Column 7,
Line 63, “as compare” should be -- as compared --.

Column 12,
Line 38, “multiply” should be -- multi-ply --.
Line 64, “Finally, the…” should begin a new paragraph.

Column 14,
Line 18, “with and adhesive” should be -- with an adhesive --.

Column 15,
Line 53, “releasable” should be -- releasably --.
Line 56, “ply having said” should be -- ply in at least one direction and having said --.

Signed and Sealed this

Seventh Day of December, 2004

JON W. DUDAS
*Director of the United States Patent and Trademark Office*